US007694914B1

(12) United States Patent
Smith

(10) Patent No.: US 7,694,914 B1
(45) Date of Patent: Apr. 13, 2010

(54) PROPULSION SYSTEM FOR MODEL AIRPLANES

(76) Inventor: Joseph James Smith, 2410 Crescent Dr., La Porte, TX (US) 77571

( * ) Notice: Subject to any disclaimer, the term of this patent is extended or adjusted under 35 U.S.C. 154(b) by 220 days.

(21) Appl. No.: 12/148,705

(22) Filed: Apr. 22, 2008

Related U.S. Application Data

(63) Continuation-in-part of application No. 11/103,989, filed on Apr. 12, 2005, now Pat. No. 7,377,466.

(51) Int. Cl.
*B64D 35/02* (2006.01)

(52) U.S. Cl. ..... 244/60; 244/55; 446/57; 446/33

(58) Field of Classification Search ..... 244/153 R, 244/54, 55, 17.11, 13; 446/34, 232, 36, 37, 446/33; 416/111; 60/904
See application file for complete search history.

(56) References Cited

U.S. PATENT DOCUMENTS

| | | | | |
|---|---|---|---|---|
| 2,310,220 | A | 2/1943 | Michelis | |
| 2,860,447 | A * | 11/1958 | Muller et al. | 446/232 |
| 3,946,706 | A * | 3/1976 | Pailler | 123/54.2 |
| 4,120,468 | A * | 10/1978 | Fischer | 244/13 |
| 4,249,711 | A * | 2/1981 | Godbersen | 244/54 |
| 4,554,989 | A * | 11/1985 | Gruich et al. | 180/65.245 |
| 5,297,759 | A * | 3/1994 | Tilbor et al. | 244/17.11 |
| 5,553,574 | A * | 9/1996 | Duncalf | 123/197.3 |
| 5,765,512 | A | 6/1998 | Fraser | |
| 5,971,320 | A * | 10/1999 | Jermyn et al. | 244/17.25 |
| 6,062,176 | A * | 5/2000 | Berger | 123/54.1 |
| 6,179,248 | B1 * | 1/2001 | Putman et al. | 244/36 |
| 6,412,454 | B1 | 7/2002 | Green | |
| 6,550,719 | B2 * | 4/2003 | Konig | 244/55 |
| 6,568,980 | B2 | 5/2003 | Barthold | |
| 6,769,384 | B2 | 8/2004 | Dougherty | |
| 6,811,460 | B1 * | 11/2004 | Tilbor et al. | 446/34 |
| 6,895,835 | B2 | 5/2005 | Cordeiro | |
| 7,011,275 | B2 | 3/2006 | Redfern | |
| 7,093,788 | B2 * | 8/2006 | Small et al. | 244/12.2 |
| 7,275,973 | B2 * | 10/2007 | Ong | 446/37 |
| 7,364,114 | B2 * | 4/2008 | Wobben | 244/12.3 |
| 7,377,466 | B1 | 5/2008 | Smith | |
| 7,407,424 | B2 * | 8/2008 | Choi | 446/37 |
| 2005/0233672 | A1 * | 10/2005 | Shantz | 446/232 |
| 2008/0006739 | A1 * | 1/2008 | Mochida et al. | 244/60 |
| 2008/0108273 | A1 * | 5/2008 | Alden | 446/34 |
| 2008/0184906 | A1 * | 8/2008 | Kejha | 102/374 |
| 2009/0117812 | A1 * | 5/2009 | Van de Rostyne et al. | 446/37 |
| 2009/0197499 | A1 * | 8/2009 | Davis | 446/57 |
| 2009/0250549 | A1 * | 10/2009 | Wiggerich | 244/17.11 |
| 2010/0003886 | A1 * | 1/2010 | Cheng et al. | 446/37 |

OTHER PUBLICATIONS figures from www.wawu.eu/modellmotor (http://web.archive.org) dated Mar. 21, 2007 (internal combustion V-12 configuration for model RC cars).*

* cited by examiner

*Primary Examiner*—Benjamin P Lee
(74) *Attorney, Agent, or Firm*—Karen B. Tripp

(57) ABSTRACT

A propulsion system for miniature vehicles, such as model airplanes, having multiple direct-current motors arranged about a central axis of the propulsion system in a radial, opposed, in-line, or V-12 configuration. The motors drive a propeller system.

10 Claims, 21 Drawing Sheets

FIG. 3
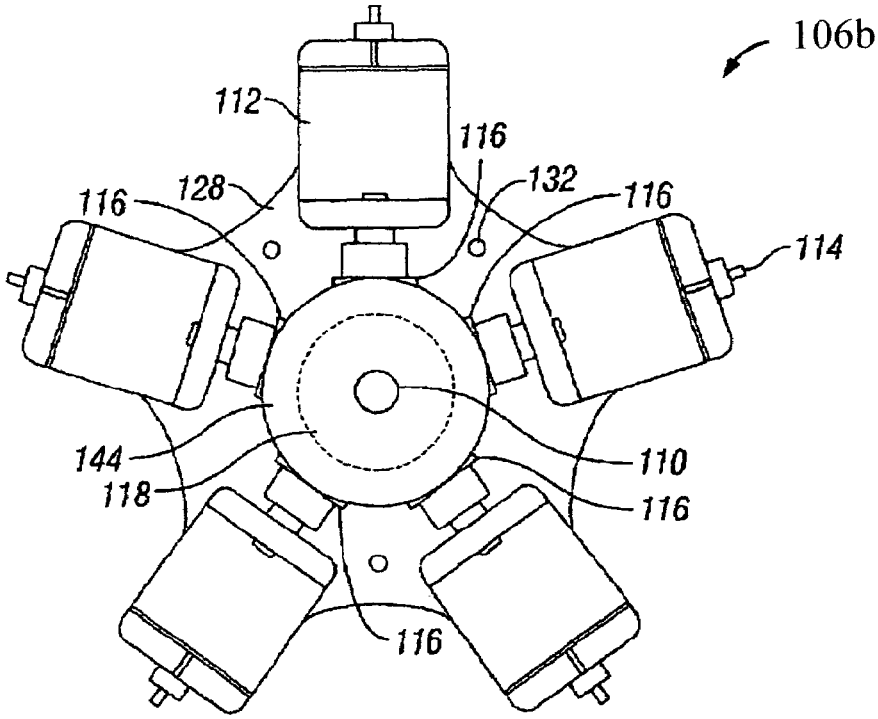
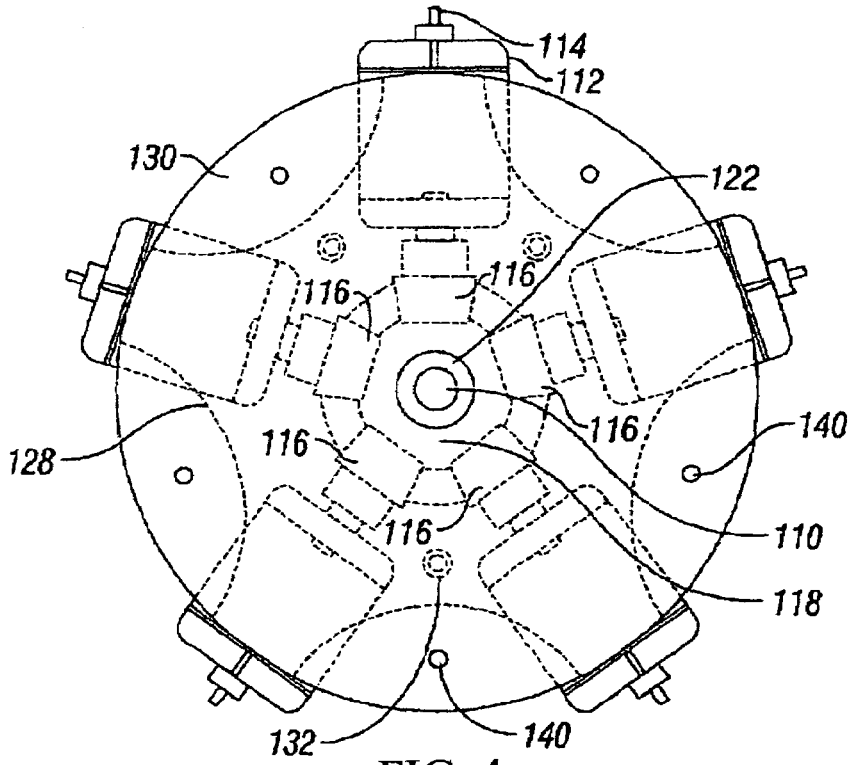
FIG. 4

PROPULSION SYSTEM FOR MODEL AIRPLANES

RELATED APPLICATION

This application is a continuation-in-part of U.S. patent application Ser. No. 11/103,989, filed Apr. 12, 2005, now U.S. Pat. No. 7,377,466, the contents of which is incorporated herein by reference.

FIELD OF THE INVENTION

This invention relates to a propulsion system for miniature vehicles. More particularly, the invention relates to an electric-powered propulsion system for miniature vehicles such as aircraft.

BACKGROUND OF THE INVENTION

The popularity of the radio-control hobby, as it applies to miniature or model aircraft, cars, boats and miniature military vehicles, has seen dramatic growth in recent years. Advancements in electric power technology, such as the increase in power-to-weight ratio of electric motors and batteries, have encouraged interest in the hobby for all age groups.

Today's radio-controlled models are less expensive and can be purchased ready or almost ready-to-fly or launch. Aircraft models are typically made of molded foam in attractive colors with motors and control equipment pre-installed.

An important factor in the use of electric propulsion is the extreme quietness of the units. Noise pollution is almost non-existent so electric models, particularly aircraft, can be flown at almost any park, school ground or ball field.

Most recently the challenges of electric flight have diminished to the point that it has become a common form of propulsion for all types of miniature aircraft.

All electric, radio-controlled models are believed to utilize a single motor or multiple single motor configurations.

It is the intent of this invention to provide a propulsion system that can be used on model airplanes.

It is a further intent of this invention to provide a propulsion system that allows a scale-like, electric motor to power models of World War I and II vintage aircraft. There are many examples of these aircraft such as English Sopwith Camels, German Fokker Tri-planes and a vast selection of United States bi-plane trainers, fighter planes and civilian aircraft. All of the above examples sold to the public at this time use single motor configurations.

It is the intent of this invention to offer an electric propulsion system that is powerful and offers the additional advantage of scale-like appearance and sound.

It is a further intent of this invention to provide a multiple-cylinder, electric motor propulsion system, in a radial, opposed, in-line (i.e., vertical), or V-12 configuration, to power miniature model planes at a scale-like speed that is safe, quiet, durable and economical to operate and that enhances the appearance of any scale-type model by more closely duplicating in appearance the original, full-scale type of engine.

SUMMARY OF THE INVENTION

This invention is a propulsion system for use in a miniature vehicle, particularly a model airplane, having a motor assembly comprised of a plurality of direct current motors operating together and arranged either radially, opposed, in-line (i.e., vertically), or in a V-12 configuration from a central axis of the motor assembly.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is a front view of a five cylinder radially configured motor assembly of the present invention along lines A-A' of FIG. 2.

FIG. 4 is a rear view of a five cylinder radially configured motor assembly of the present invention.

FIG. 25 is a top or end view of one of the motors for the V-12 cylinder Merlin type motor assembly of FIG. 24.

FIG. 26 is a side view of one of the motors for the V-12 cylinder Merlin type motor assembly of FIG. 24.

DESCRIPTION OF THE PREFERRED EMBODIMENT

Figure 1A:
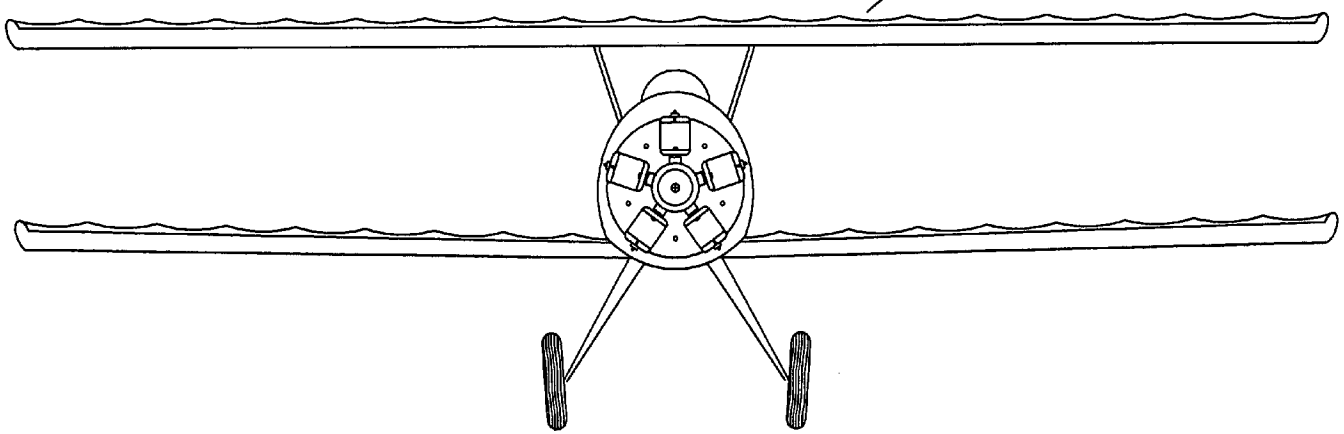
FIG. 1*a* is a frontal view of one embodiment of the propulsion system of the present invention, having five cylinders or electric motors in a radial configuration, as mounted on one type of a miniature aircraft, with the propeller cutaway.
Figure 1B:
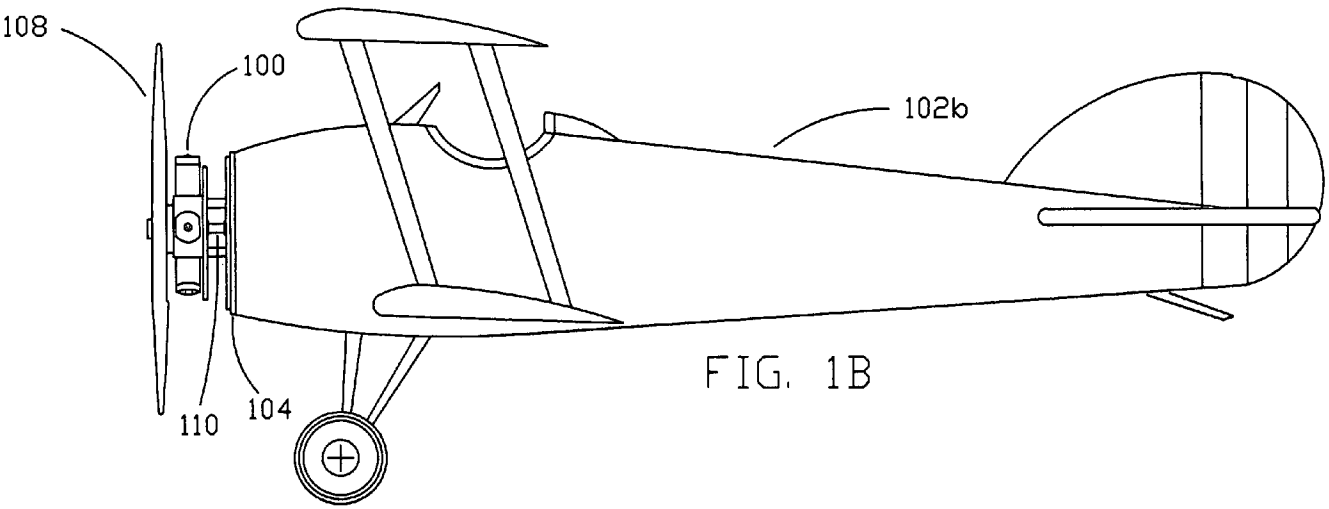
FIG. 1*b* is a side view of the propulsion system of FIG. 1*a* installed on a different type of a miniature aircraft, with the propeller in place.

Referring now to the drawings, it is noted that like reference characters designate like or similar parts throughout the drawings. The figures, or drawings, are not intended to be to scale. For example, purely for the sake of greater clarity in the drawings, wall thicknesses and spacings are not dimensioned as they actually exist in the assembled embodiments.

FIGS. 1*a*, 28*a*, 29*a*, 30*a*, and 31*a* are frontal views of some preferred embodiments of the propulsion system 100 mounted on a miniature aircraft 102*a* or 102*c*. FIGS. 1*b*, 28*b*, 29*b*, 30*b*, and 31*b* are side views of some preferred embodiments of the propulsion system 100 mounted on the front of the aircraft 102*a* or 102*b* or 102*c* by attaching the propulsion system 100 to a firewall 104 in the aircraft 102*a*, 102*b* or 102*c*, respectively.

Figure 2:
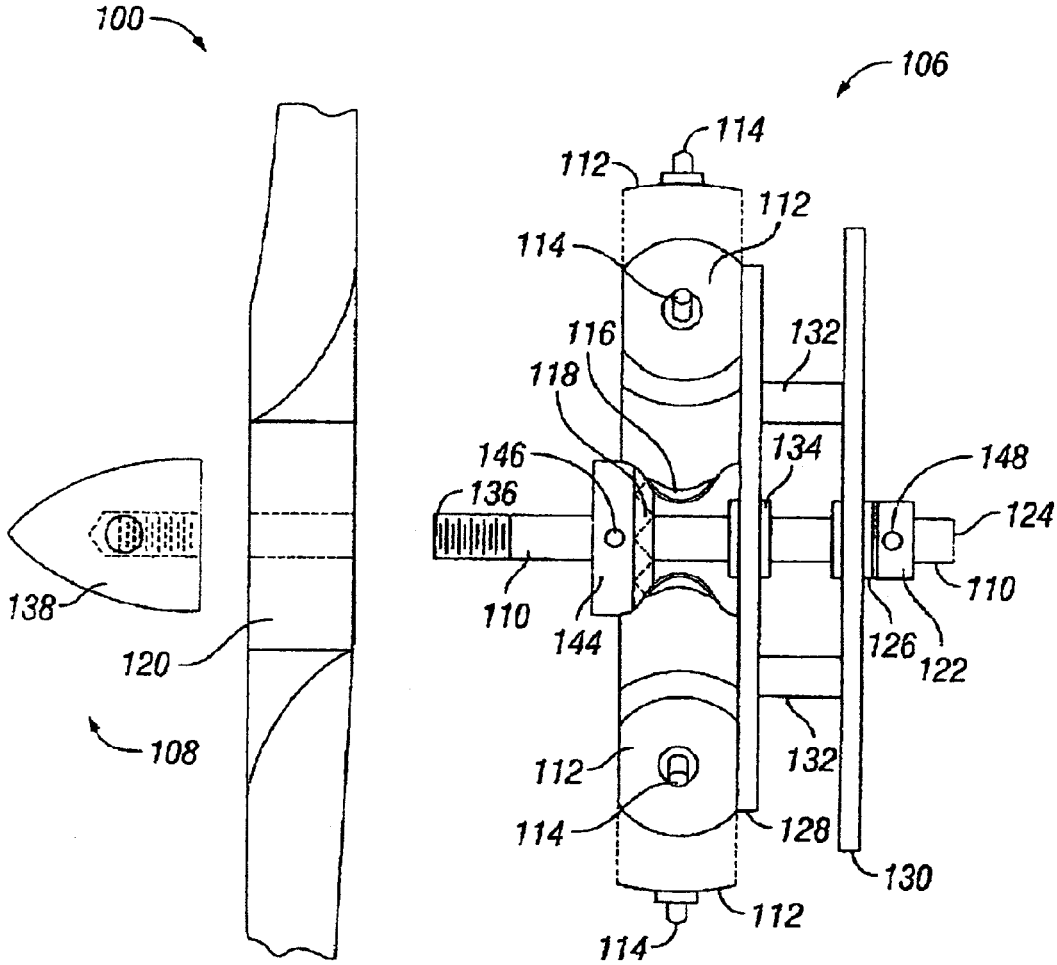
FIG. 2 is a partially-exploded side view of the embodiment of the propulsion system of FIG. 1*a* showing the propeller assembly, the motor assembly and the drive shaft of the present invention.
Figure 5:
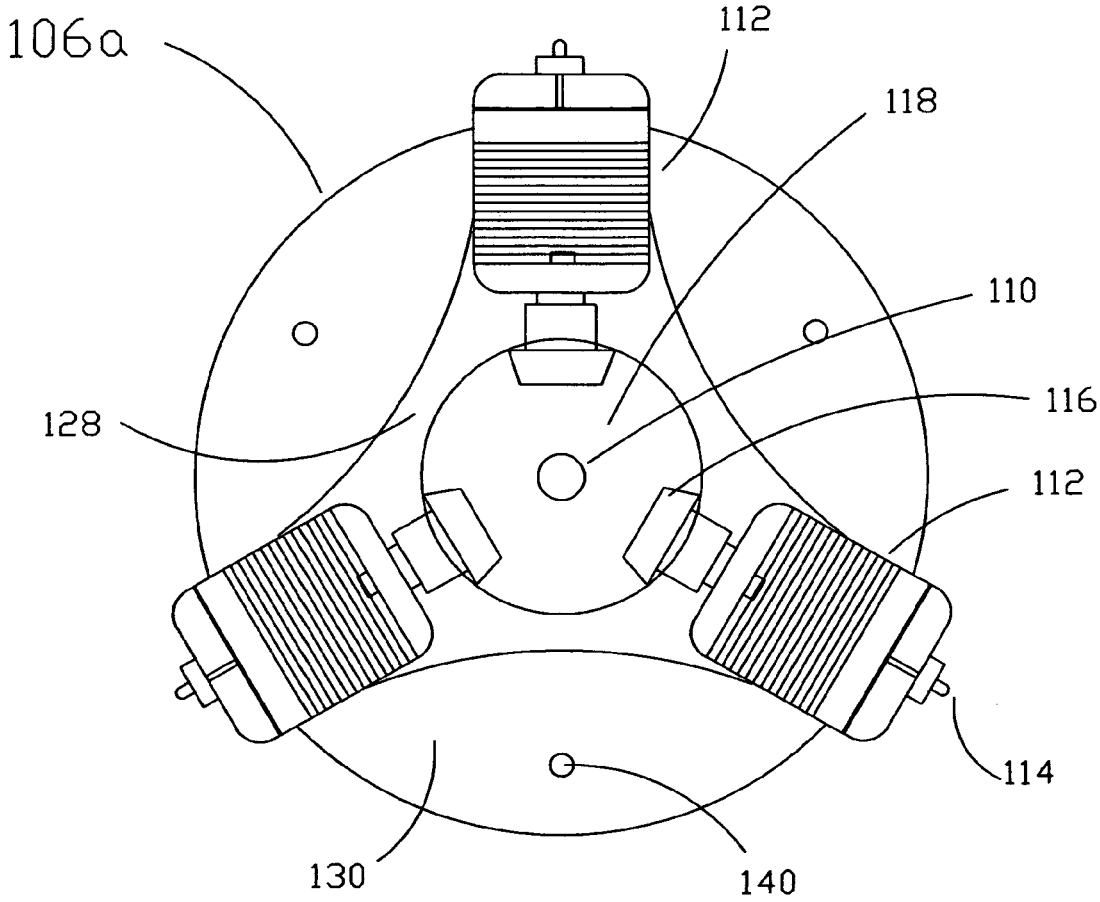
FIG. 5 is a front view of a three cylinder radially configured motor assembly of the present invention.

The propulsion system 100 of the preferred embodiment includes the elements shown in FIG. 2, for example, and other figures discussed herein. The details of the preferred embodiment are discussed below and include a motor assembly 106 and a propeller assembly 108 connected together with a drive shaft 110.

As shown in the front views in FIGS. 3, 5, 7, and 8, the motor assembly 106 (106*a*, 106*b*, 106*c*, 106*d*, respectively) of a preferred radial embodiment utilizes three, five, seven or nine small, approximately 3-7 volt direct current electric motors 112 configured in a symmetrical pattern that is radially disbursed from the drive shaft 110 which is the axis of the motor assembly 106. The motors must be configured properly for the voltage, weight, torque and amperage specifications of the desired unit. The five-unit embodiment of FIG. 1*a* is meant by way of example and is not intended to limit the scope of the invention.

The radial motor configuration emulates the advantage of the fly-wheel effect produced by a large propeller (not shown). This effect is what develops the maximum power of the motor assembly 106 and allows the aircraft 102*a* and 102*b* to fly. This phenomenon also is evident in full-scale aircraft designed with radial engines (not shown). Conversely, increasing the voltage and RPM has little effect on power output and only serves to use more energy.

The dimensions of the individual motors 112 in all of the preferred embodiments herein are approximately 1⅜" long by 1" wide with about a ⅜" long by 2 mm diameter motor shaft 114. The top and bottom of the individual motors 112, which may also be referred to herein as "cylinders," are approximately flat which makes the height of the motors 112 approximately ¾. Cylindrical motors (not shown) of approximately the same size and power requirements also can be used. All dimensions are meant by way of example and are not meant to limit the scope of the invention.

As shown in FIGS. 2, 3, 4, 5, 6*a*, 6*b*, 7, 8, 9, 10, 11, 13, 14, 17, 18, 19, 21, 23, 24, 25, 26, and 27, each DC motor 112 has approximately a ½ inch diameter, 45-degree pinion gear 116 pressed onto the respective motor 112. All of the pinion gears 116 mate to a main gear 118. The main gear 118 is about 1½ inches in diameter. The final gear ratio (pinion to main gear) is preferably 3:1 and turns a 14-inch diameter by 10-inch pitch propeller 120 approximately 2300 RPM. This 3:1 ratio is critical to the proper rotational speed of the propeller 120, which is targeted for optimum flight time and power. With the five motor radial configuration of the invention, for example, this 3:1 gear ratio produces about 12.9 ounces of thrust at a 3.9 ampere draw from a 12-volt flight battery (not shown). The thrust and ampere draw will vary, however, with the number of motors. For the nine motor radial configuration of FIG. 8, a 4:1 final gear ratio may be substituted for the 3:1 gear ratio to allow for a larger gear to accommodate the nine DC motors in the radial configuration.

The main gear 118 and the pinion gears 116 can be made of nylon, plastic or other light-weight, non-conductive material. Only a slight amount of lubricant (not shown) is required for the main gear 118 and the pinion gears 116. Typically, one small drop is sufficient for every ten flights.

As illustrated in FIGS. 2, 3, 4, 5, 6*a*, 6*b*, 7, and FIG. 8, the 45-degree configuration of the main gear 118 and the pinion gears 116 allows the motors 112 to be mounted flat and in a radial arrangement around the main gear 118, with the motor shafts 114 of the motors 112 positioned perpendicular to the drive shaft 110. This mounting configuration replicates a full-scale aircraft engine (not shown). Additionally, having the main gear 118 mounted forward of the pinion gears 116 provides a way to easily adjust the pinion-to-main gear clearance. The clearance is set by simply sliding the propeller assembly 108 and the main gear 118 forward and off the pinion gears 116 and inserting a strip of material of known thickness, such as a common business card, to set the clearance at the desired depth of 0.005-0.008 inches. Proper gear spacing is important to reduce drag.

Similarly, in an alternative embodiment illustrated in FIGS. 9, 10, 11 and 29*c*, the 45-degree configuration of the main gear 118 and the pinion gears 116 allows the motors 112 to be mounted flat in an arrangement of opposed pairs of two, four, or six motors 112 around the main gear 118, with the motor shafts 114 of the motors 112 positioned perpendicular to the drive shaft 110. This mounting configuration replicates a different type full-scale aircraft engine (not shown) than the one with a radial engine arrangement. As with the radial arrangement, the main gear 118 is preferably mounted forward of the pinion gears 116 to provide a way to easily adjust the pinion-to-main gear clearance. The final gear ratio (pinion to main gear) is preferably 3:1.

In another alternative embodiment illustrated in FIGS. 12, 13, 14, and 30*b*, the 45-degree configuration of the main gear 118 and the pinion gears 116 allows the motors 112 to be mounted flat in an in-line or vertical arrangement of four or six motors 112 around the main gear 118, with the motor shafts 114 of the motors 112 positioned perpendicular to the drive shaft 110. This mounting configuration replicates a different type full-scale aircraft engine (not shown) than the one with a radial engine arrangement. As with the radial arrangement, the main gear 118 is preferably mounted forward of the pinion gears 116 to provide a way to easily adjust the pinion-to-main gear clearance.

Figure 19:
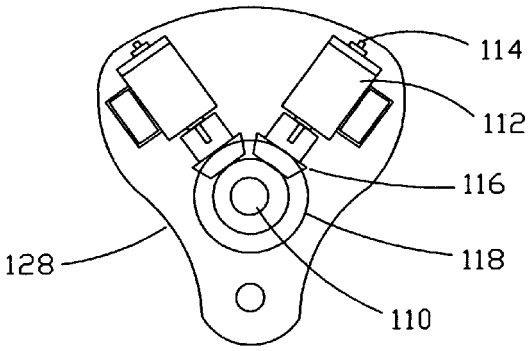
FIG. 19 is a front view of a two engine portion of the V-12 cylinder Merlin type motor assembly of FIG. 18.
Figure 20:
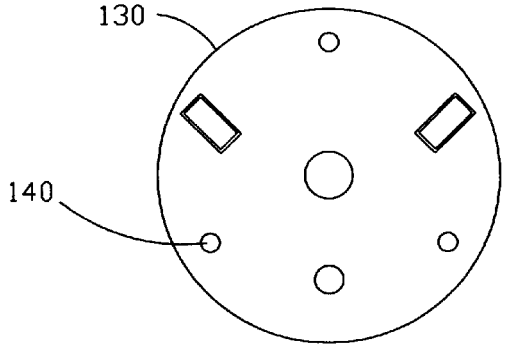
FIG. 20 is a front view of the mounting plate for the V-12 cylinder Merlin type motor assembly of the present invention, without the V-12 motor attached.

In still another embodiment, as illustrated in FIGS. 18, 19, 21, 24 and 31*c*, the 45-degree configuration of the main gear 118 and the pinion gears 116 allows the motors 112 to be mounted flat and in a V-12 arrangement around the main gear 118, with the motor shafts 114 of the motors 112 positioned at an angle to the drive shaft 110. That is, each of six pairs of motors 112 are positioned at 72° angles with respect to each other, when measuring between the motor shafts 114 as shown in FIG. 19 and perpendicular with respect to the drive shaft 110. This mounting configuration also replicates a full-scale aircraft engine popularly known as the Merlin (not shown). As with the other embodiments, the main gear 118 is preferably mounted forward of the pinion gears 116 to provide a way to easily adjust the pinion-to-main gear clearance.

Figure 6A:
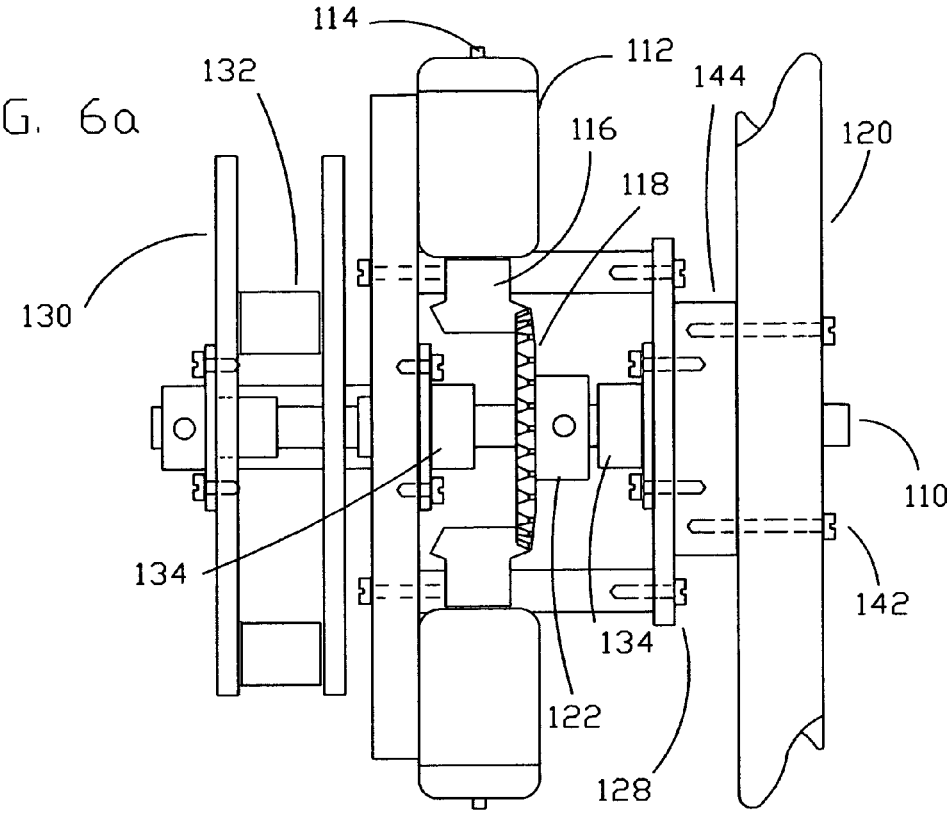
FIG. 6*a* is a side view of a five cylinder radially configured motor assembly of the present invention for a Rhone-type installation where the cylinders spin with the propeller of the aircraft.
Figure 6B:
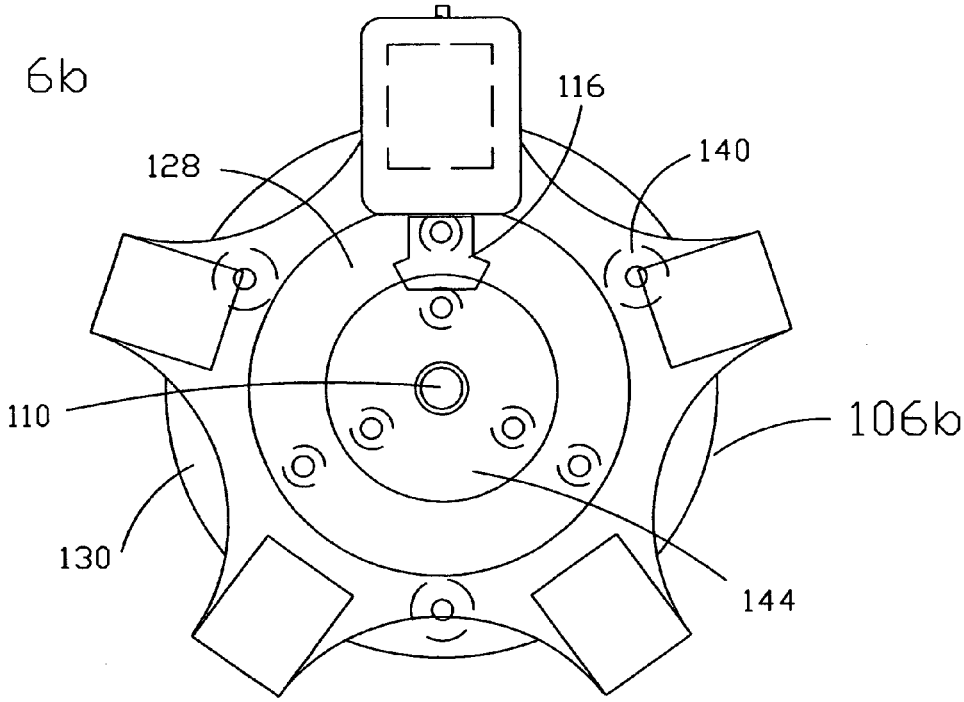
FIG. 6*b* is a front view of the motor assembly of FIG. 6*a*.
Figure 7:
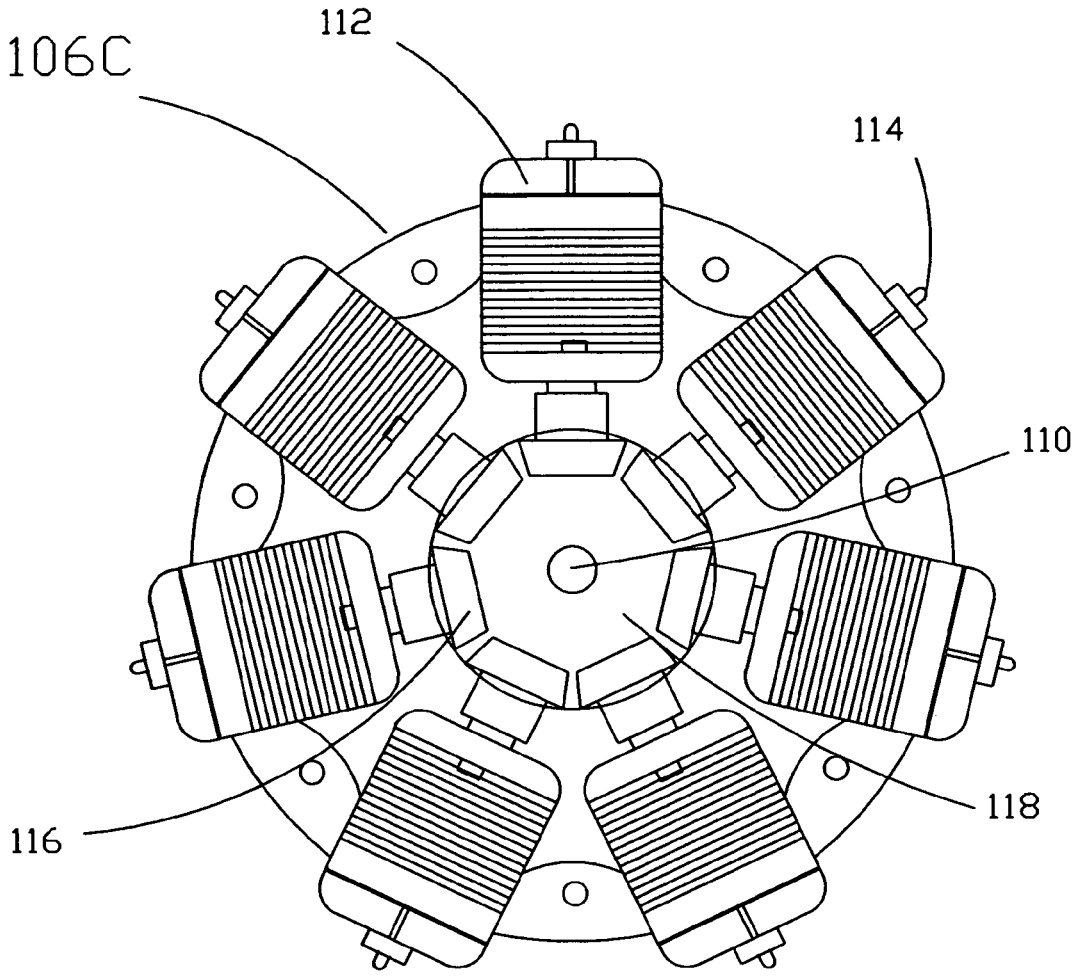
FIG. 7 is a front view of a seven cylinder radially configured motor assembly of the present invention.
Figure 8:
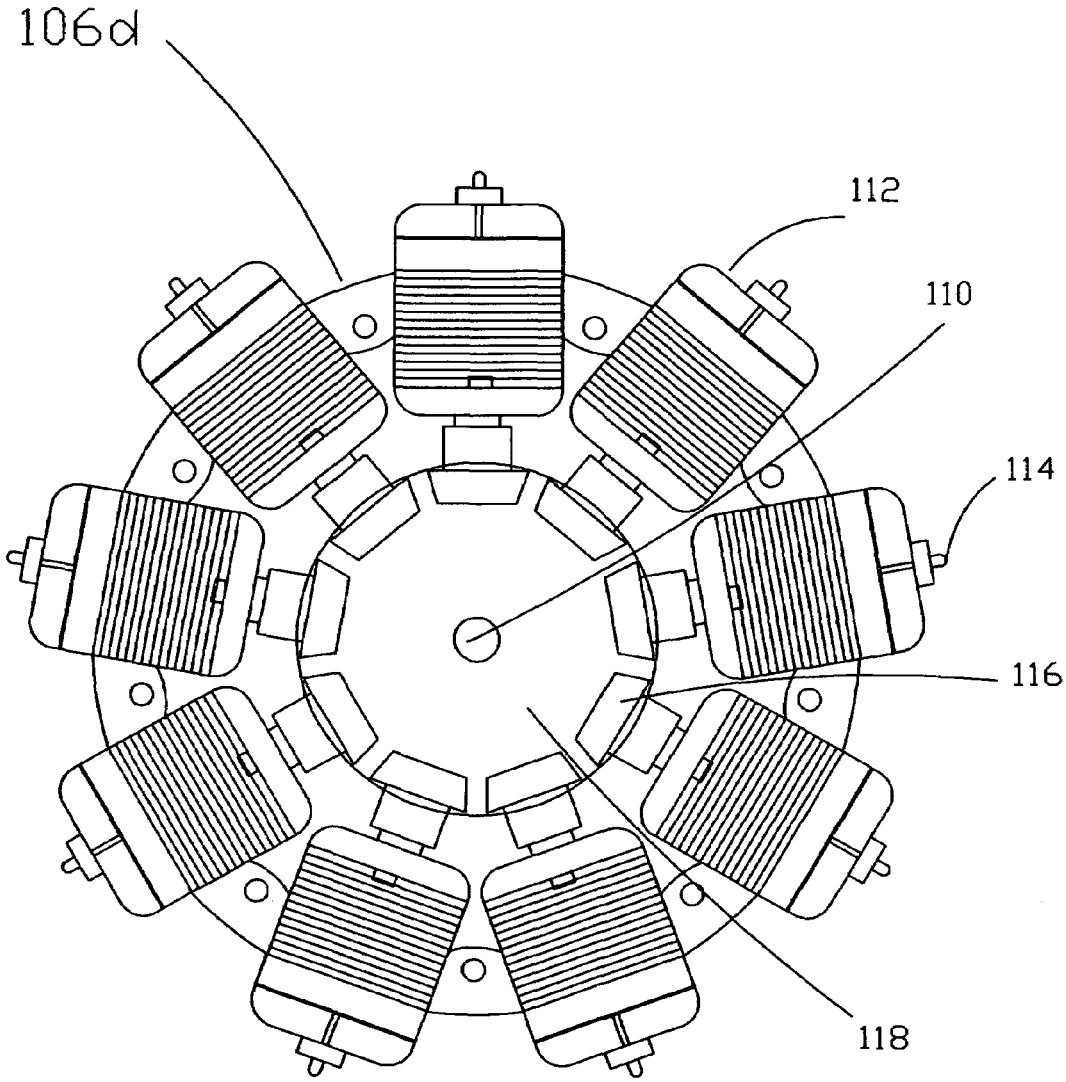
FIG. 8 is a front view of a nine cylinder radially configured motor assembly of the present invention.
Figure 9:
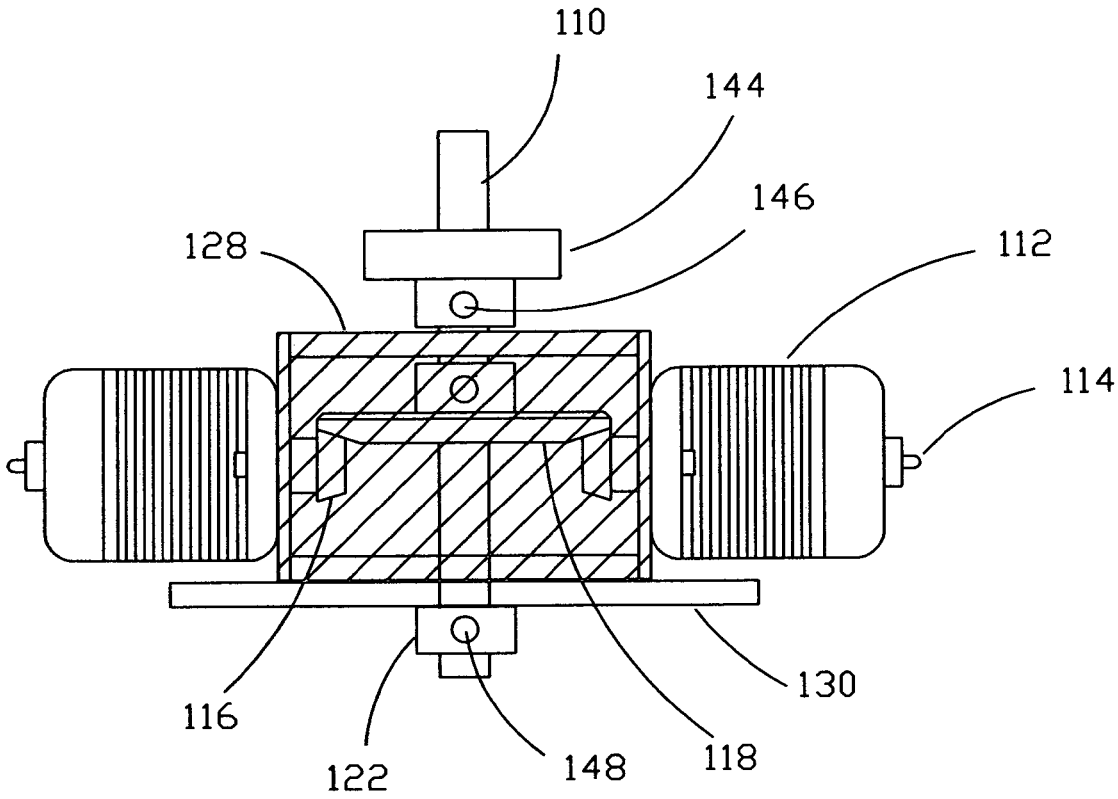
FIG. 9 is a top view of a twin cylinder motor assembly of the present invention in an opposed configuration.
Figure 10:
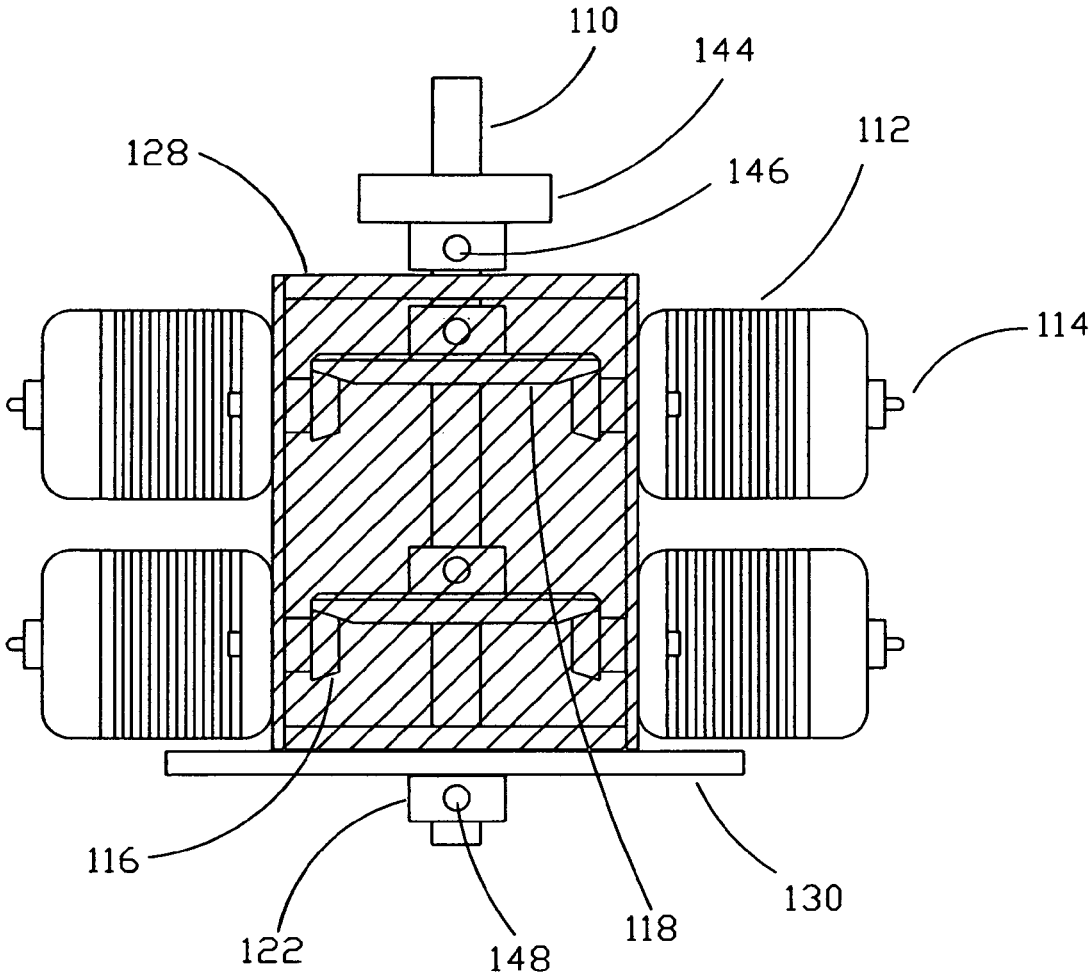
FIG. 10 is a top view of a four cylinder motor assembly of the present invention in an opposed configuration.
Figure 11:
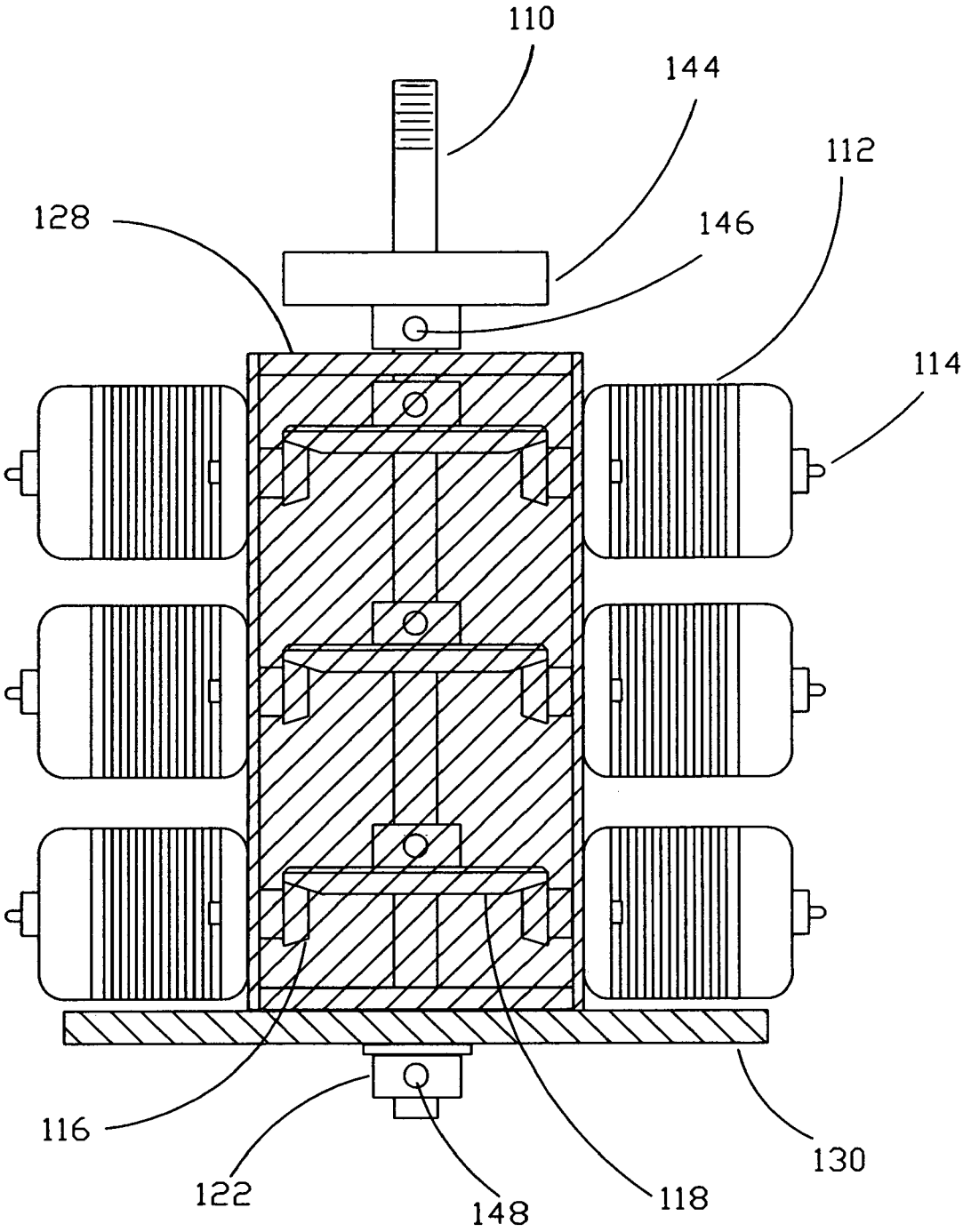
FIG. 11 is a top view of a six cylinder motor assembly of the present invention in an opposed configuration.
Figure 12:
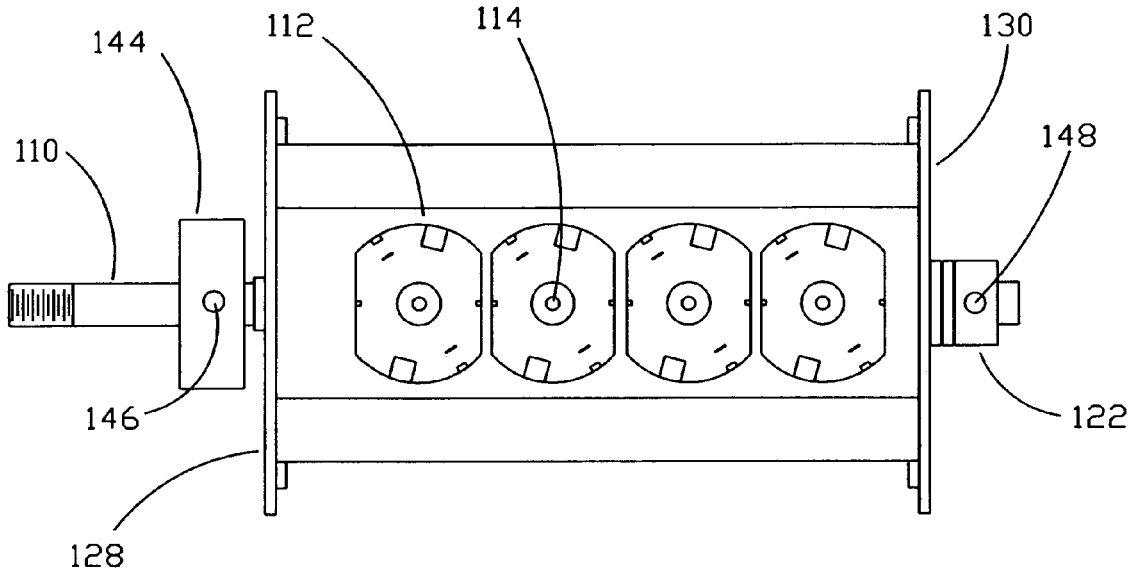
FIG. 12 is a top view of a four cylinder motor assembly of the present invention in an in-line or vertical configuration.
Figure 13:
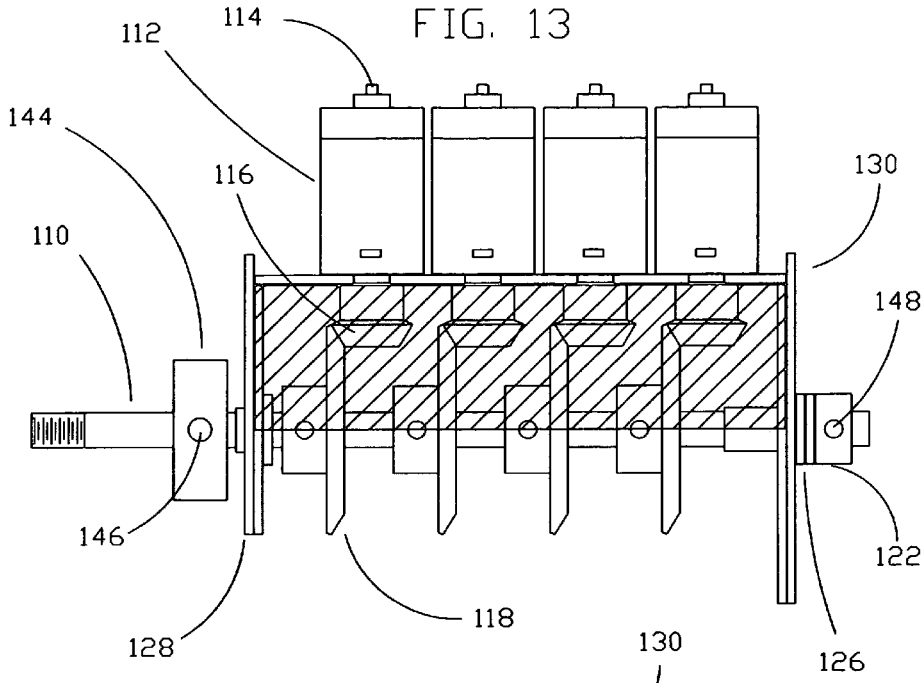
FIG. 13 is a side view of a four cylinder motor assembly of the present invention in an in-line or vertical configuration.
Figure 14:
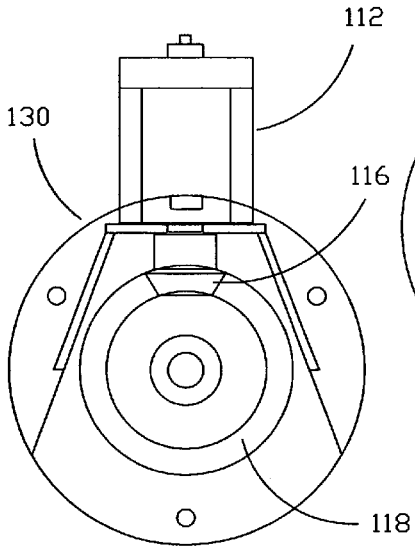
FIG. 14 is a front view of a four cylinder motor assembly of the present invention in an in-line or vertical configuration.
Figure 15:
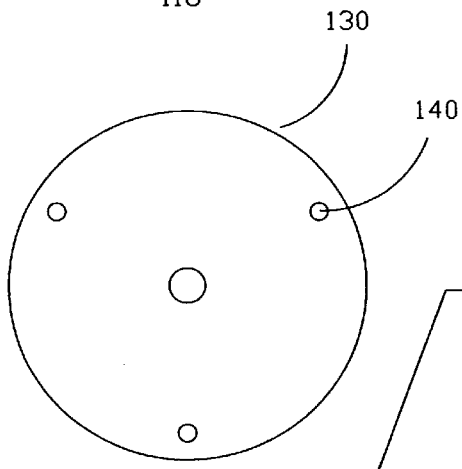
FIG. 15 is a front view of the rear mounting plate for the four cylinder inline motor assembly of FIG. 14, without the motor being shown.

In a further embodiment, as illustrated in FIGS. 6*a* and 6*b*, the 45-degree configuration of the main gear 118 and the pinion gears 116 allows the motors 112 to be mounted flat and in a radial arrangement around the main gear 118, with the motor shafts 114 of the motors 112 positioned perpendicular to the drive shaft 110, also as in FIGS. 3 and 4. However, in this alternative embodiment, the motors 112 are attached to the drive shaft 110*a* such that the motors 112 spin with the drive shaft 110*a* and with the propeller (not shown), instead of themselves remaining stationary while the drive shaft 110*a* spins the propeller. This mounting configuration replicates still another full-scale aircraft engine (not shown) popularly known as the Rhone.

In all of the arrangements or embodiments herein, the gear clearance is locked in place by a thrust collar 122 at the distal end 124 of the drive shaft 110. The thrust collar 122 is pinned to the drive shaft 110 by a set screw 148 and rides on a thrust washer 126. It serves to secure the drive shaft 110 to a front mounting plate 128 and a rear mounting plate 130. The rear mounting plate 130 has equally-spaced mounting holes 140 (FIGS. 4, 5, 6*b*, 7, 8, 19, and 21) around the edge of the plate 130 to allow screws (not shown) to pass through the rear mounting plate 130 to mount the propulsion system 100 to the firewall 104 in the aircraft 102*a*, 102*b* or 102*c*.

Figure 16:
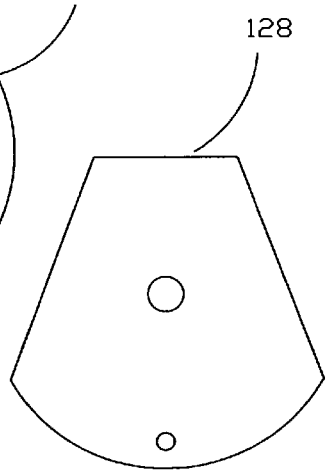
FIG. 16 is a front view of the front mounting plate for the four cylinder inline motor assembly of FIG. 14, without the motor being shown.
Figure 17:
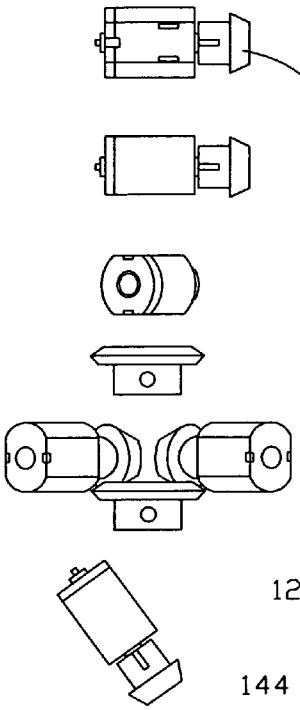
FIG. 17 is a partially exploded parts view of a cylinder pair portion of a V-12 cylinder Merlin type motor assembly of the present invention.
Figure 18:
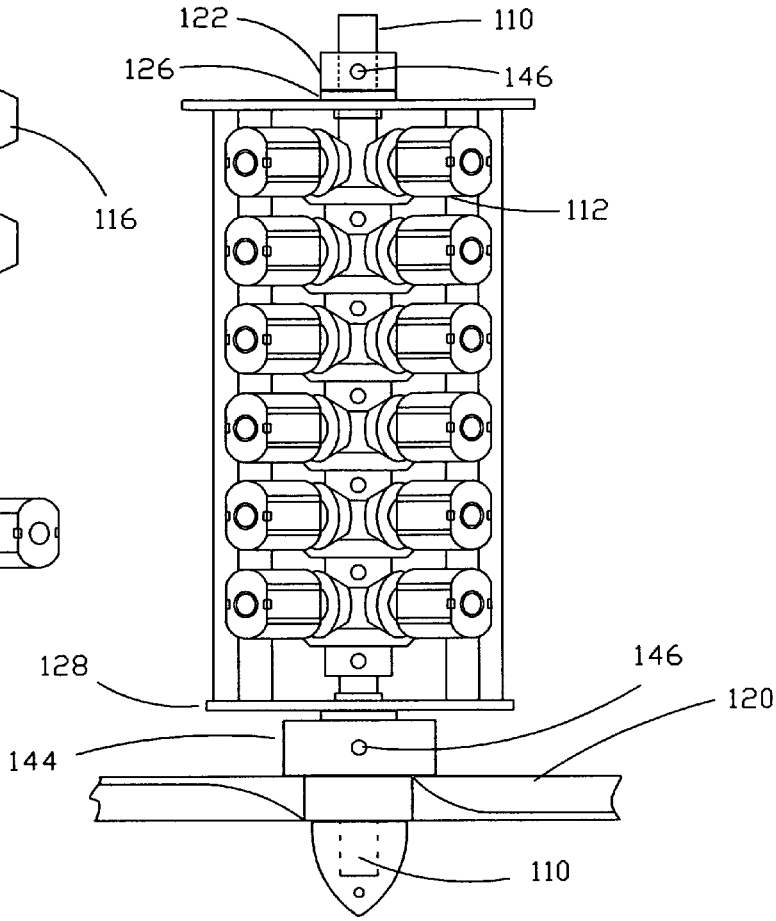
FIG. 18 is a top view of a V-12 cylinder Merlin type motor assembly of the present invention.
Figure 21:
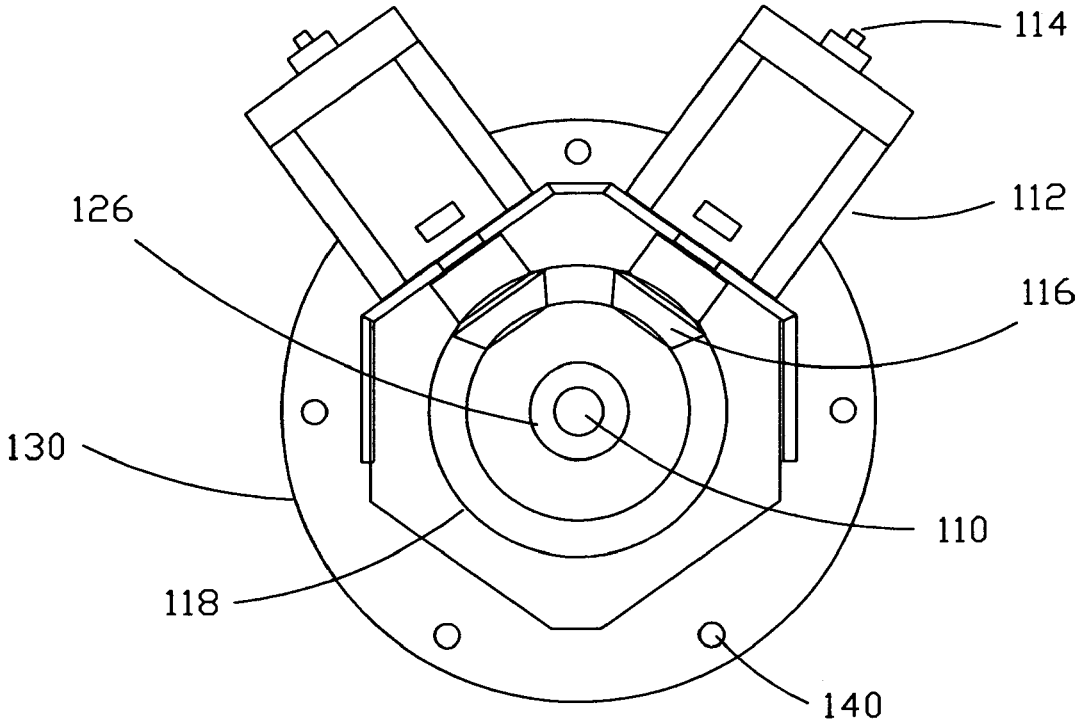
FIG. 21 is a front view of the V-12 cylinder Merlin type motor assembly of the present invention, showing the front and rear support or mounting plates.
Figure 22:
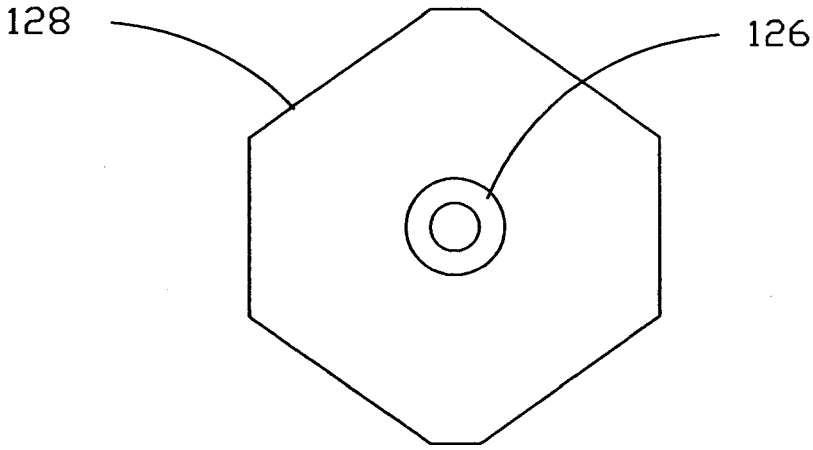
FIG. 22 is a front view of the front support plate for the V-12 cylinder Merlin type motor assembly of FIG. 21.
Figure 23:
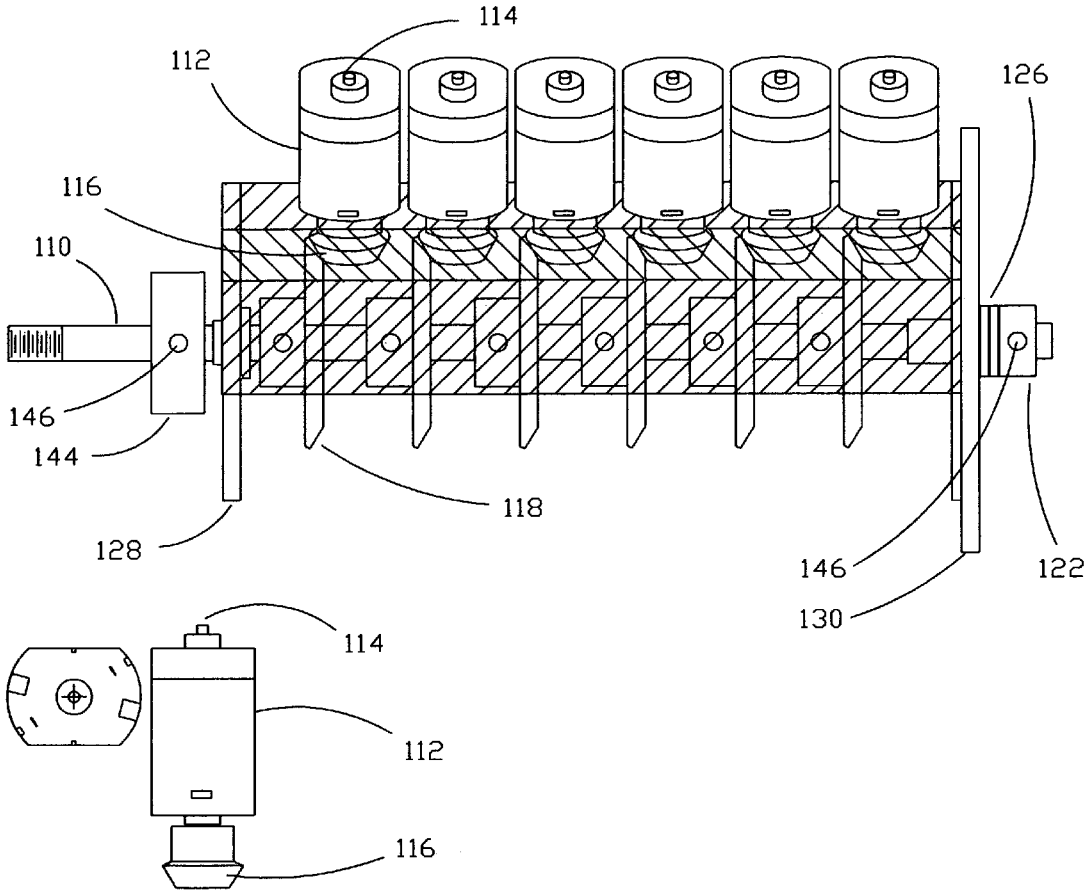
FIG. 23 is a side view of the V-12 cylinder Merlin type motor assembly of the present invention.
Figure 24:
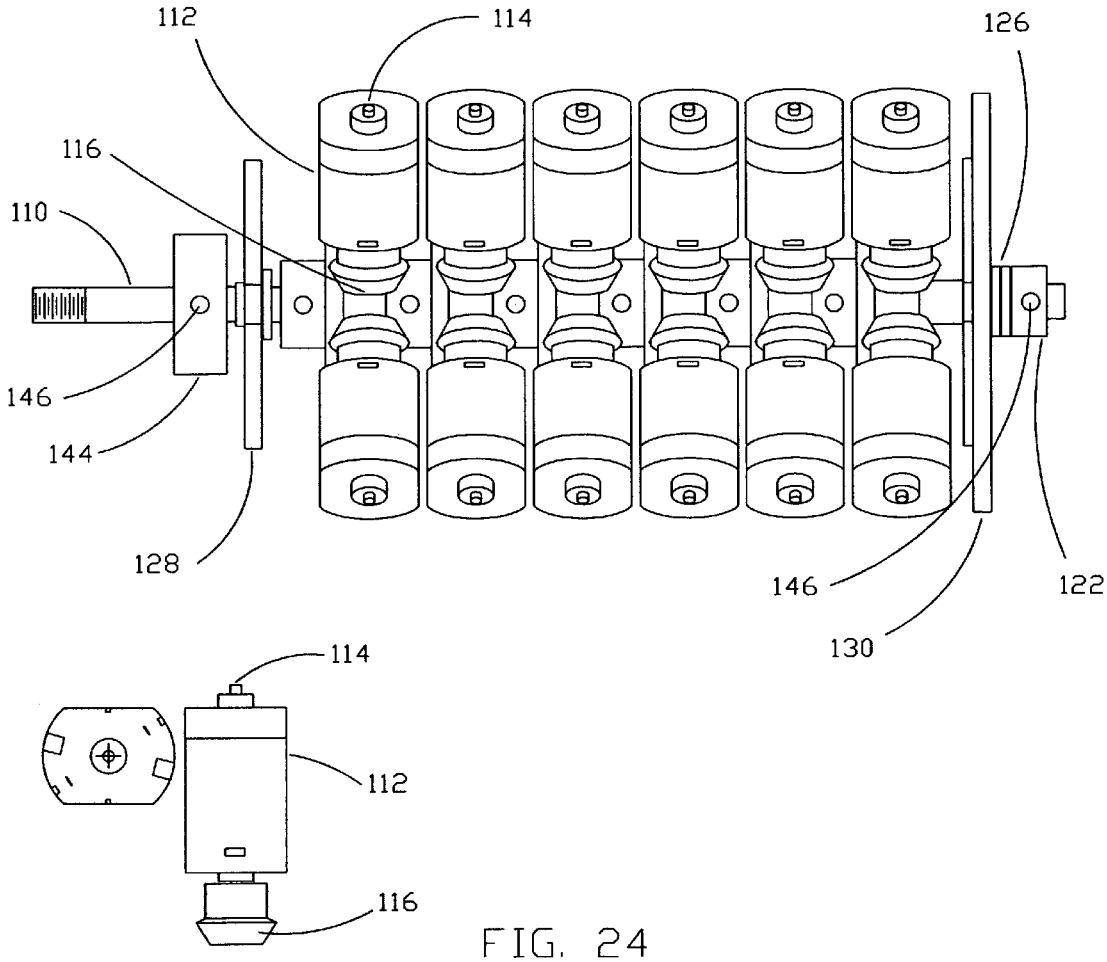
FIG. 24 is a top view of the V-12 cylinder Merlin type motor assembly of the present invention.
Figure 27:
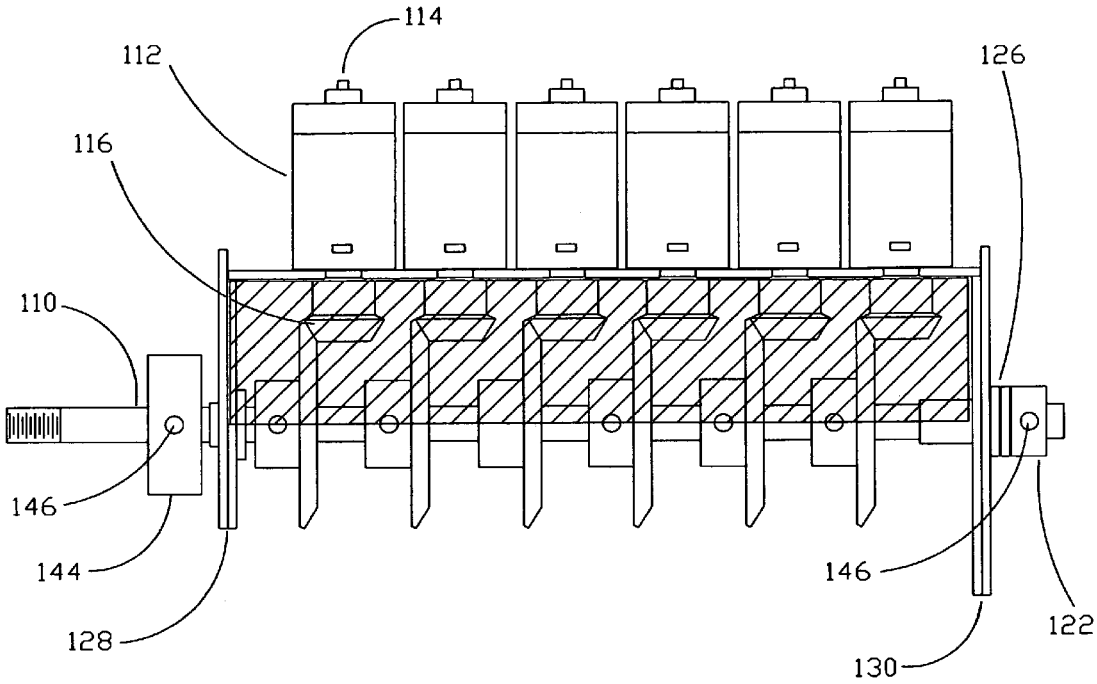
FIG. 27 is a side view of a 6 cylinder inline motor assembly of the present invention.
Figure 28A:
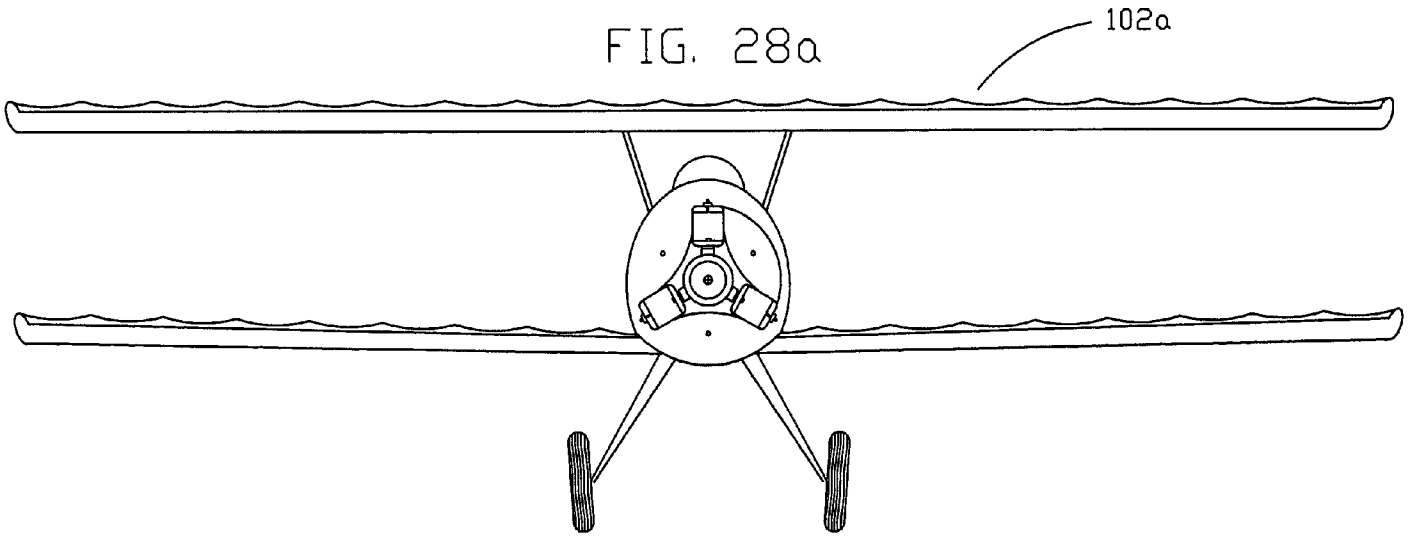
FIG. 28*a* is a frontal view of another embodiment of the propulsion system of the present invention, having three cylinders or electric motors in a radial configuration, as mounted on one type of a miniature aircraft, with the propeller cutaway.
Figure 28B:
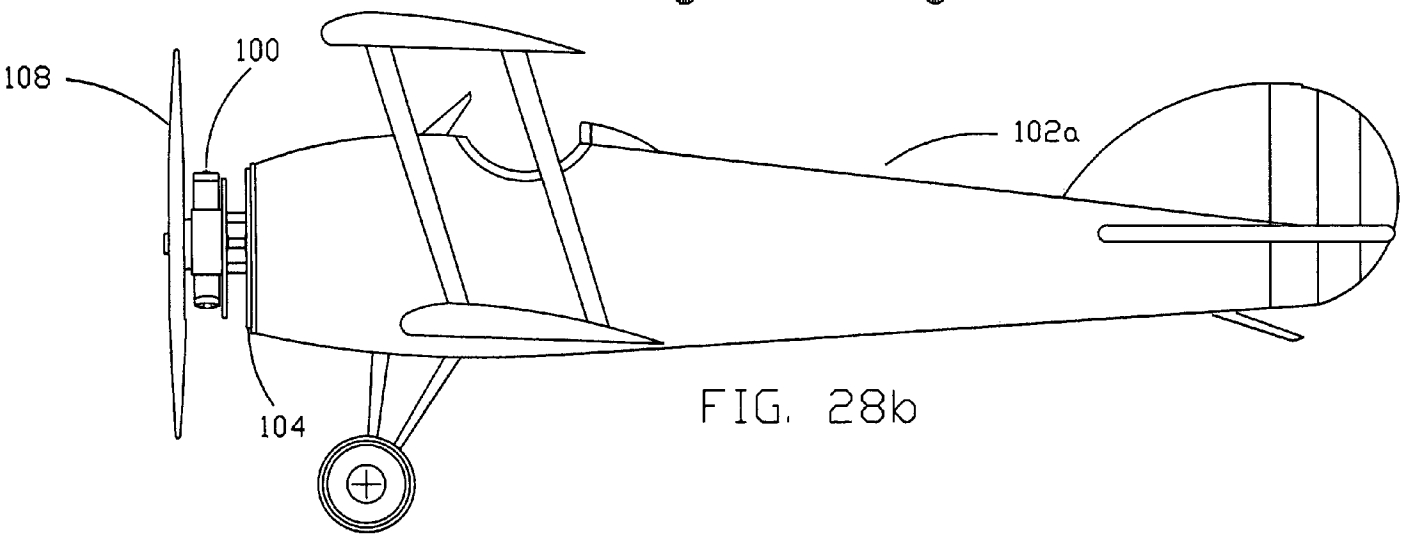
FIG. 28*b* is a side view of the propulsion system of FIG. 28*a* installed on the same miniature aircraft, with the propeller in place.
Figure 29A:
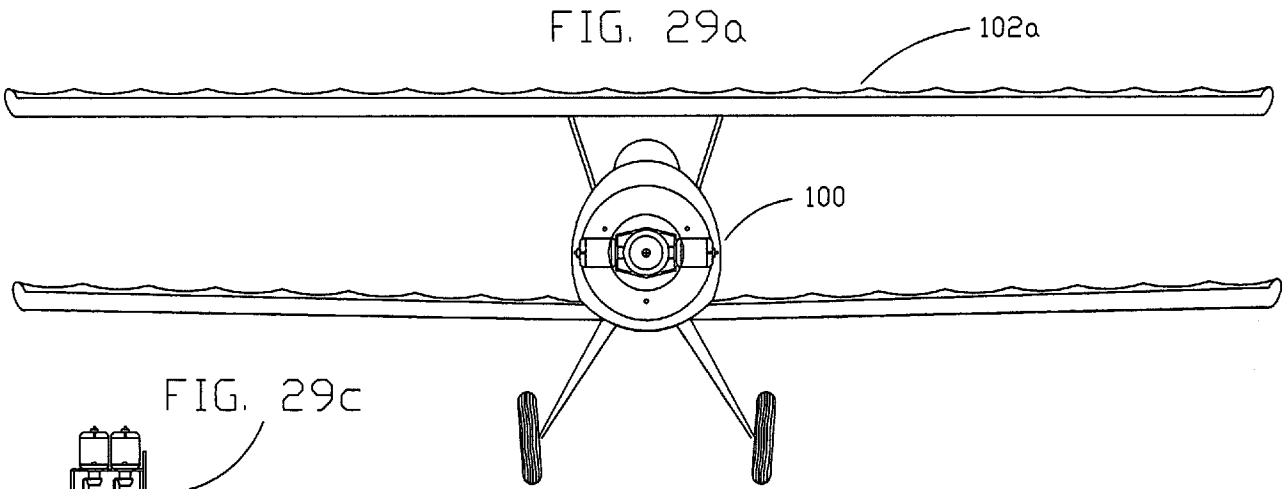
FIG. 29*a* is a frontal view of another embodiment of the propulsion system of the present invention, having four cylinders or electric motors in an opposed configuration, as mounted on one type of a miniature aircraft, with the propeller cutaway.
Figure 29B:
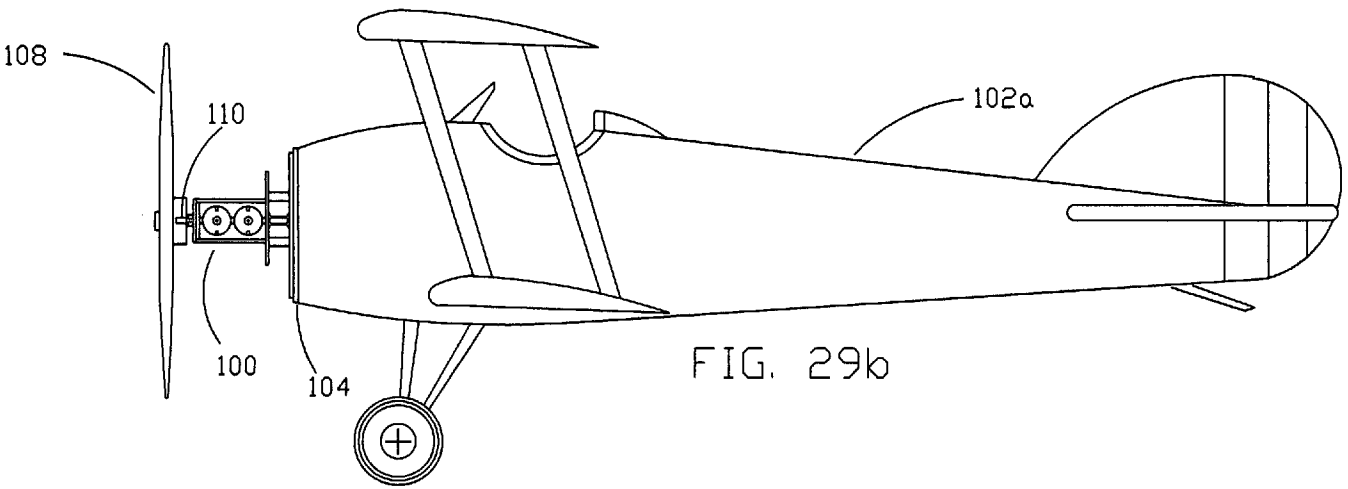
FIG. 29*b* is a side view of the propulsion system of FIG. 29*a* installed on the same miniature aircraft, with the propeller in place.
Figure 29C:
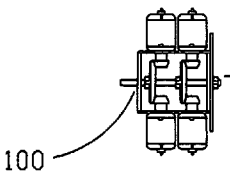
FIG. 29*c* is a top view of the motor assembly used in the miniature aircraft in FIGS. 29*a* and 29*b*.
Figure 30A:
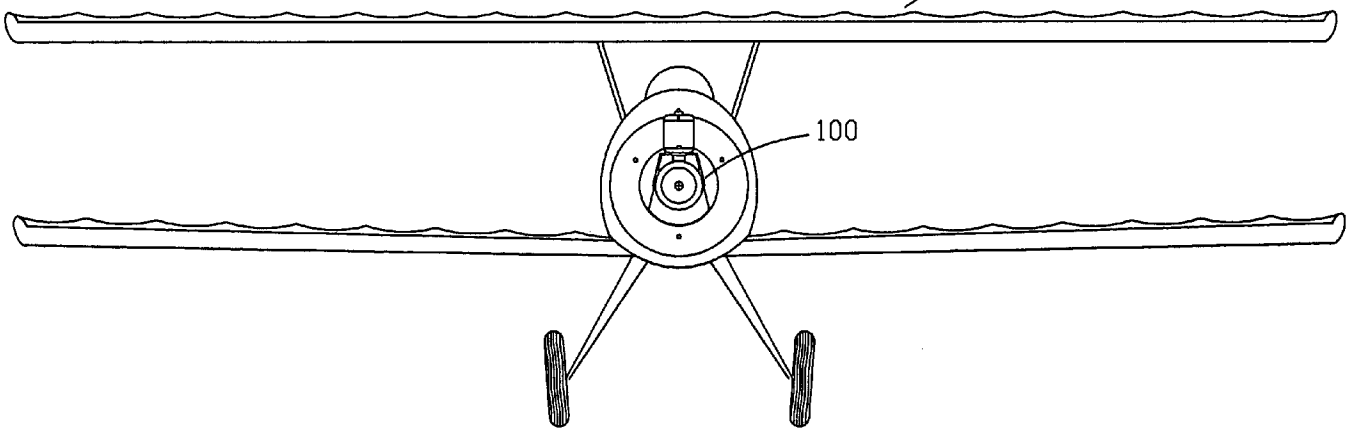
FIG. 30*a* is a frontal view of another embodiment of the propulsion system of the present invention, having four cylinders or electric motors in an in-line configuration, as mounted on one type of a miniature aircraft, with the propeller cutaway.
Figure 30B:
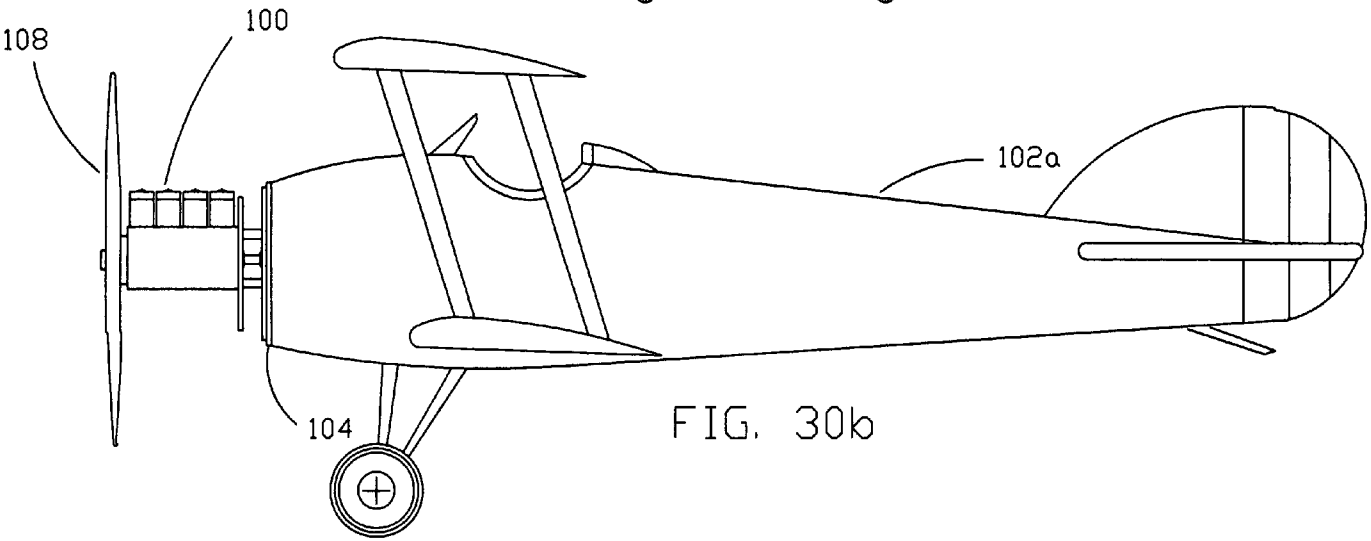
FIG. 30*b* is a side view of the propulsion system of FIG. 30*a* installed on the same miniature aircraft, with the propeller in place.
Figure 31A:
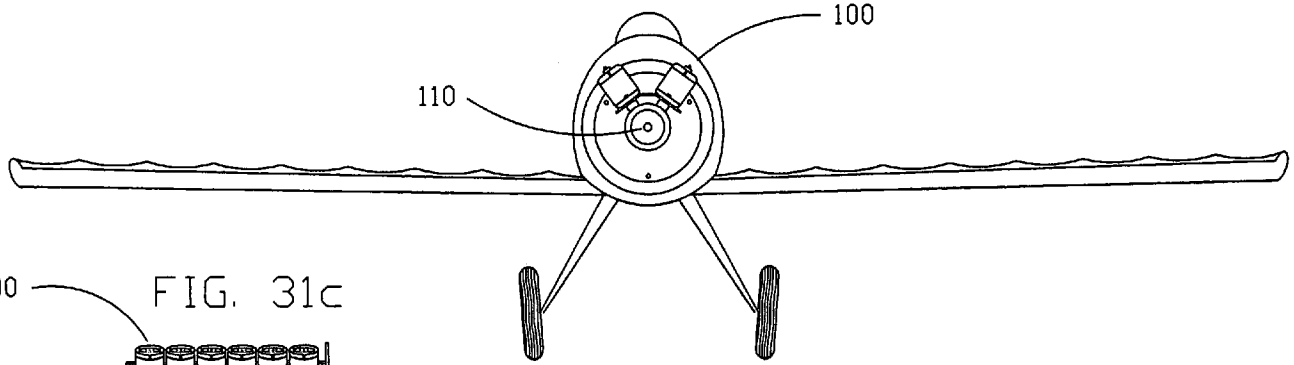
FIG. 31*a* is a frontal view of another embodiment of the propulsion system of the present invention, having twelve cylinders or electric motors in a V-12 configuration, as mounted on one type of a miniature aircraft, with the propeller cutaway.
Figure 31C:
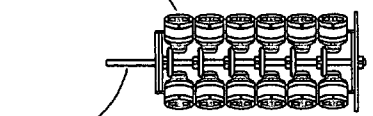
FIG. 31*c* is a top view of the motor assembly used in the miniature aircraft in FIGS. 31*a* and 31*b*.
Figure 31B:
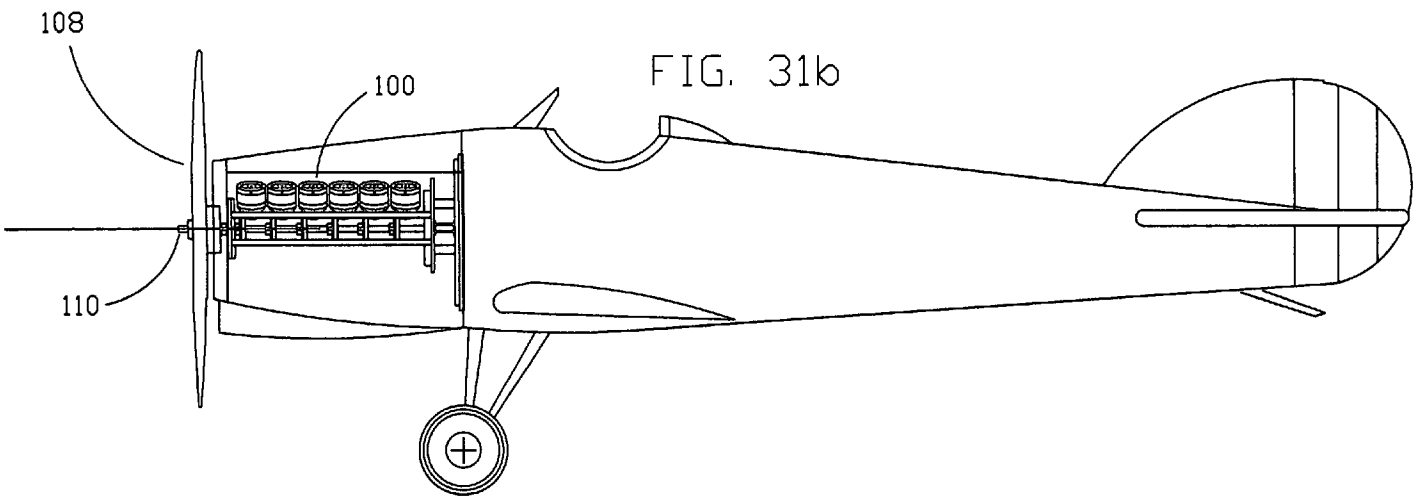
FIG. 31*b* is a side view of the propulsion system of FIG. 31*a* installed on the same miniature aircraft, with the propeller in place.

In preferred embodiments, the front mounting plate 128 (FIGS. 3, 4, 15, 16, and 21) is designed in a star configuration and allows airflow around the motors 112 to facilitate cooling. As shown in FIG. 2, the rear mounting plate 130 is separated from the front mounting plate 128 by ½ inch plate supports (spacers) 132. This separation or clearance between the front mounting plate 128 and the rear mounting plate 130 increases cooling by providing additional airflow space around the motors 112 and provides space for the separation of drive shaft bearings 134. This space between the front mounting plate 128 and the rear mounting plate 130 strengthens the entire motor assembly 106 and separates the drive shaft bearings 134 for precise alignment of the drive shaft 110. FIGS. 16, 19 and 21 show alternative shapes for the front mounting plates 128*a*, 128*b*, and 128*c*.

The front mounting plate 128 and the rear mounting plate 130 can be made of plywood or molded from plastic or other light-weight, non-conductive, rigid and durable material.

The dimensions of the drive shaft 110 are approximately ¼ inch by 3 inches. The drive shaft 110 can be made of nylon, plastic or other durable, light-weight, non-conductive material. The propeller 120 is mounted at the proximal end 136 of the drive shaft 110 and is secured to a propeller hub 144 by a spinner nut 138 (¼ inch by twenty-eight threads per inch). The spinner nut 138 can be made of plastic, aluminum or other similarly featured material. Propellers 120 are commonly available and are frequently made of wood or molded plastic.

The propeller hub 144 is positioned on the drive shaft 110 between the propeller 120 and the main gear 118 and rotates in synchronization with the propeller 120. The propeller hub 144 is pinned to the drive shaft 110 by a pin 146.

All wiring (not shown) is pre-installed to each motor terminal and can be color-coded for positive and negative polarity. An electrical connector can be soldered to the end of the motor wires for connecting to an electronic throttle control device (not shown) provided by the kit manufacturer or consumer.

The propulsion system 100 can be easily installed on many ready made and quick-assembly kits for miniature aircraft 102*a* and/or 102*b* and/or 102*c* for example as shown in FIGS. 1*a*, 1*b*, 28*a*, 29*a*, 30*a*, and 31*a*. Short screws (not shown) are used to connect the propulsion system 100 to the aircraft firewall 104. The flight transmitter (not shown) sends commands to the electronic throttle control device (not shown) that controls the throttle on/off and power setting of the propulsion system 100. The Rhone-type embodiment of the present invention, as illustrated in FIGS. 6*a* and 6*b*, may not or will not necessarily have a throttle.

The flight batteries (not shown) are quick charged from a 12-volt field battery (not shown) or automobile batteries (not shown) on site. Many 800 milliamp flights can be made during the normal flying session.

Flight duration with a typical 30-inch span bi-plane (FIGS. 1*a*, 28*a*, 29*a*, and 30*a*) with 400-500 square inches of wing area, weighing 28 ounces, will typically last about 20-30 minutes. However, exact flying time depends on the amount of aerobatics performed and throttle setting, wind speeds and other factors. The motors 112 also can be wired in parallel (not shown) for more power but less flight time.

It is anticipated that those skilled in the art of motors will recognize various other ways of practicing the invention and other uses of the invention. While the invention has been particularly shown and described with reference to the preferred embodiment thereof, it will be understood by those skilled in the art that various changes in form and detail may be made therein without departing from the scope of the invention, as set forth in the following claims.

100 propulsion system (106+108+110)
102*a* miniature aircraft
102*b* miniature aircraft
102*c* miniature aircraft
104 firewall in aircraft
106 motor assembly (112+128+130+116+118)
108 propeller assembly (138+120+144)
110 drive shaft
112 DC motors
114 motor shafts
116 pinion gears
118 main gear
120 propeller
122 thrust collar
124 distal end of the drive shaft
126 thrust washer/drive shaft bearings
128 front mounting plate
130 rear mounting plate
132 spacers/plate supports
134 flange/drive shaft bearings
136 proximal end of the drive shaft
138 spinner nut
140 mounting holes (in rear mounting plate)
142 screws
144 propeller hub
146 pin (propeller hub to drive shaft)
148 set screw (thrust collar to drive shaft)

The invention claimed is:

1. A propulsion system sized for use in a radio controlled miniature model airplane, comprising a motor assembly further comprised of a dozen direct-current (DC) motors operating cooperatively and arranged in six pairs positioned 72° apart in a V-12 configuration and perpendicular from the central axis of the motor assembly, which provides propulsion to said miniature vehicle.

2. The propulsion system of claim 1, further comprising: a propeller system and a drive shaft.

3. The propulsion system of claim 2, further comprising:

a front bearing plate having an aperture for receiving the drive shaft, wherein the DC motors are arranged in six pairs in a V-12 configuration on the front mounting plate; and wherein the drive shaft is the central axis of the opposing arrangement of the DC motors;

wherein each of the DC motors further comprises a pinion gear at the end towards the drive shaft; and a main gear having an aperture for receiving the drive shaft, wherein the main gear is positioned on the drive shaft in front of the DC motors and mated with the pinion gears of the DC motors; and wherein the motor assembly is attached to the propeller system via the drive shaft and to the miniature aircraft.

4. The propulsion system of claim 3, further comprising a rear mounting plate having an aperture for receiving the drive shaft, wherein the rear mounting plate is positioned on the drive shaft behind the front mounting plate; and wherein the motor assembly is attached to the miniature aircraft via the rear mounting plate.

5. The propulsion system of claim 3 wherein said pinion gear of each motor is a 45-degree pinion gear which enables the perpendicular positioning of the motor to the central axis/drive shaft.

6. A propulsion system sized for use in a radio controlled miniature model airplane, comprising a drive shaft and a motor assembly further comprised of four or six direct-current (DC) motors operating cooperatively to rotate said drive shaft and arranged in an inline configuration perpendicular from the drive shaft comprising the central axis of the motor assembly, which provides propulsion to said miniature vehicle.

7. The propulsion system of claim 6, further comprising: a propeller system.

8. The propulsion system of claim 7, further comprising:

a front bearing plate having an aperture for receiving the drive shaft, wherein the DC motors are arranged in an inline configuration on the front mounting plate; and wherein each of the DC motors further comprises a pinion gear at the end towards the drive shaft; and a main gear having an aperture for receiving the drive shaft, wherein the main gear is positioned on the drive shaft in front of the DC motors and mated with the pinion gears of the DC motors; and wherein the motor assembly is attached to the propeller system via the drive shaft and to the miniature aircraft.

9. The propulsion system of claim 8, further comprising a rear mounting plate having an aperture for receiving the drive shaft, wherein the rear mounting plate is positioned on the drive shaft behind the front mounting plate; and wherein the motor assembly is attached to the miniature aircraft via the rear mounting plate.

10. The propulsion system of claim 8 wherein said pinion gear of each motor is a 45-degree pinion gear which enables the perpendicular positioning of the motor to the central axis/drive shaft.

* * * * *